US006445372B1

(12) United States Patent
Asai

(10) Patent No.: US 6,445,372 B1
(45) Date of Patent: Sep. 3, 2002

(54) FLAT-PANEL DISPLAY DEVICE

(75) Inventor: Yoshihiro Asai, Himeji (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/531,156

(22) Filed: Mar. 17, 2000

(30) Foreign Application Priority Data

Mar. 19, 1999 (JP) ..... 11-074846

(51) Int. Cl.[7] ..... G09G 3/36

(52) U.S. Cl. ..... 345/99; 345/94; 345/671; 345/698; 345/100

(58) Field of Search ..... 345/92, 87, 93, 345/94, 99, 98, 100, 698, 208, 667, 671

(56) References Cited

U.S. PATENT DOCUMENTS 4,809,345 A * 2/1989 Tabata et al. ..... 345/667
5,805,149 A * 9/1998 Yuki et al. ..... 345/555
6,219,020 B1 * 4/2001 Furuhashi et al. ..... 345/100
6,262,704 B1 * 7/2001 Kurumisawa et al. ..... 345/100
6,281,869 B1 * 8/2001 Seino ..... 345/100

FOREIGN PATENT DOCUMENTS

JP 4-309920 11/1992

* cited by examiner

*Primary Examiner*—Kent Chang
(74) *Attorney, Agent, or Firm*—Oblon, Spivak, McClelland, Maier & Neustadt, P.C.

(57) ABSTRACT

A flat-panel display device includes a display control unit having a scanning line driver for periodically selecting at least two adjacent scanning lines and driving such lines together. A scanning controller controls a driver to turn on elements connected to a first one of the adjacent scanning lines located on one side of a row of the pixels capacitively coupled thereto and driven for the row of pixels, and elements connected to a second one of the adjacent scanning lines located on another side of the row of pixels capacitively coupled thereto and not driven for the row of pixels, at a substantially identical timing, and to turn off the elements connected to second adjacent scanning line earlier than the elements connected to the first adjacent scanning line.

11 Claims, 10 Drawing Sheets

FLAT-PANEL DISPLAY DEVICE

CROSS-REFERENCE TO RELATED APPLICATIONS

This application is based upon and claims the benefit of priority from the prior Japanese Patent Application No. 11-074846, filed Mar. 19, 1999, the entire contents of which are incorporated herein by reference.

BACKGROUND OF THE INVENTION

The present invention relates to a flat-panel display device in which a plurality of display pixels are arranged in a matrix, and in particular, to a flat-panel display device in which a single video signal is supplied concurrently to rows of display pixels for zoom display, for example.

A liquid crystal display device has been used in various fields as a flat-panel display device having characteristics such as lightweight, small thickness, and low power consumption. In recent years, an active matrix liquid crystal display device has come into wide use as a display for car navigation, in addition to apparatuses such as a computer, portable remote information terminal or the like.

A typical active matrix liquid crystal display device includes a liquid crystal panel and a display control unit for controlling the liquid crystal panel. The liquid crystal panel has a plurality of display pixels arranged in a matrix, a plurality of scanning lines formed along rows of the display pixels, a plurality of signal lines formed along columns of the display pixels, and a plurality of switching elements formed in the vicinity of intersections between the scanning lines and the signal lines. Each switching element is driven via the corresponding scanning line in order to apply the potential of a corresponding signal line to a corresponding display pixel. The display control unit includes a scanning line driver connected to the liquid crystal panel to drive the scanning lines, a signal line driver connected to the liquid crystal panel to drive the signal lines, and a controller for controlling operation timings for the scanning line driver and signal line driver.

By the way, the liquid crystal display device for car navigation is constructed to have a zoom display function of partially enlarging a display image. The zoom display function is obtained by simple image processing of driving a plurality of scanning lines together, and allocating a single horizontal video signal to rows of the display pixels. This image processing technique has no need of a frame memory; therefore, it is possible to reduce a manufacturing cost of the display device.

However, inventors of this application have earnestly made a research and development; as a result, in the case where the plurality of scanning lines are driven together in the active matrix liquid crystal display device, irregularity in brightness occurs between display pixels; for this reason, it has been found that the dispersion remarkably appears accompanying with a high definition of the display device.

BRIEF SUMMARY OF THE INVENTION

In order to solve the conventional problem described above, an object of the present invention is to provide a flat-panel display device which can secure a preferable display quality even in the case where a plurality of scanning lines are driven together.

According to the present invention, the above object is attained by a flat-panel display device which comprises: a plurality of display pixels arranged in a matrix; a plurality of scanning lines formed along rows of the display pixels; a plurality of signal lines formed along columns of the display pixels; a plurality of switching elements formed in the vicinity of intersections between the scanning lines and the signal lines and each driven via a corresponding scanning line to apply a potential of a corresponding signal line to a corresponding display pixel; and a display control unit for driving the scanning lines and the signal lines; wherein the display control unit includes: a scanning line driver for periodically selecting at least two adjacent scanning lines from the plurality of scanning lines to drive the adjacent scanning lines together; and a scanning controller for controlling the scanning line driver to turn on the switching elements connected to a first one of the adjacent scanning lines which is located on one side of a row of the display pixels capacitively coupled thereto and driven for the row of display pixels, and the switching elements connected to a second one of the adjacent scanning lines which is located on another side of the row of display pixels capacitively coupled thereto and not driven for the row of display pixels, at a substantially identical timing, and to turn off the switching elements connected to the second adjacent scanning line at an earlier timing than that for the switching elements connected to the first adjacent scanning line by a predetermined period.

In the flat-panel display device, driving of the first adjacent scanning line and driving of the second adjacent scanning line are ended at different timings to obtain conditions which cause pixel potential levels of the display pixels to be shifted uniformly. Therefore, irregularity in brightness depending upon a difference of the shifted level amounts is prevented between the display pixels, so that a preferable display quality can be secured.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An active matrix liquid crystal display device according to one embodiment of the present invention will be described below with reference to the accompanying drawings.

The liquid crystal display device is a flat-panel display device having a zoom display mode of partially enlarging a display image for car navigation, in addition to a normal display mode.

Figure 1:
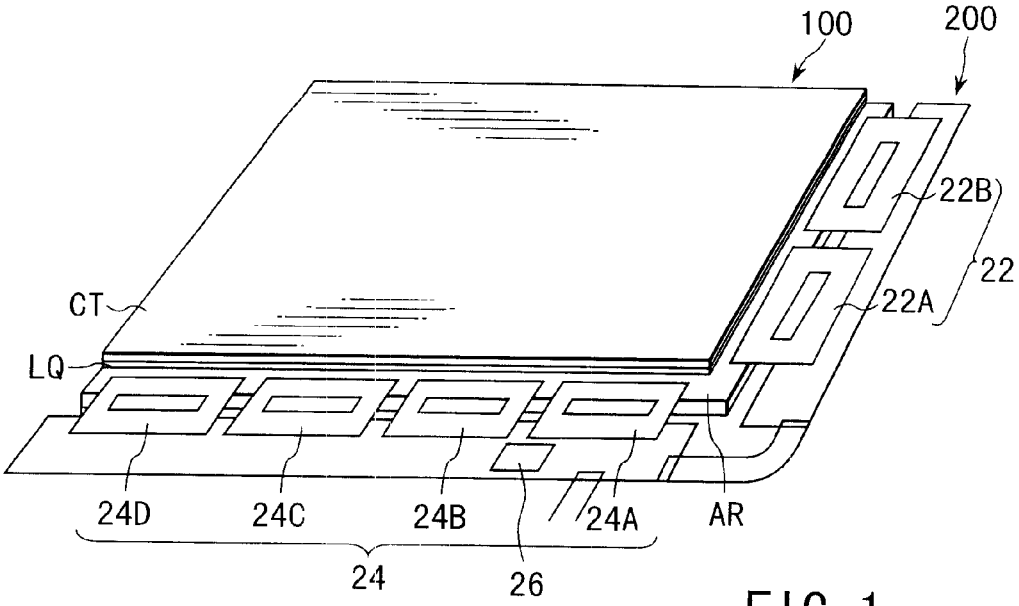
FIG. 1 is a perspective view showing an appearance of a liquid crystal display device according to one embodiment of the present invention.
Figure 2:
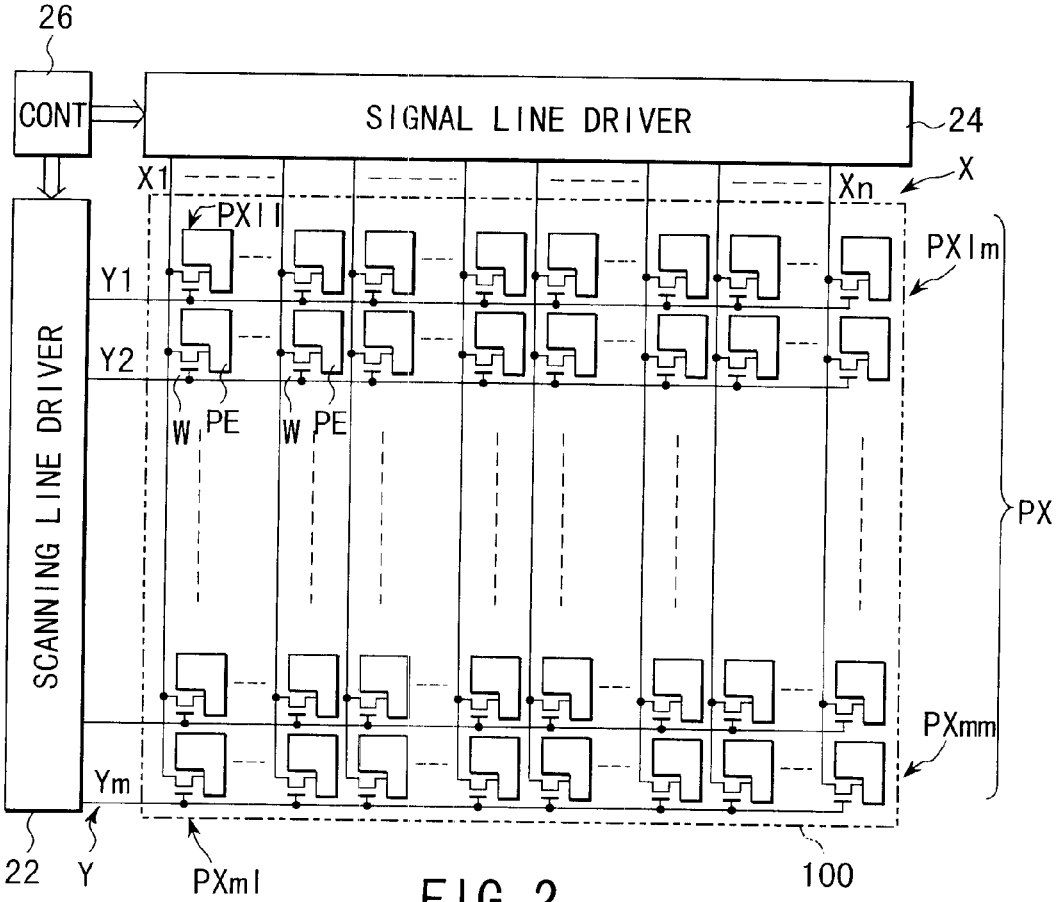
FIG. 2 is a circuit diagram of the liquid crystal display device shown in FIG. 1.

FIG. 1 shows an appearance of the liquid crystal display device, and FIG. 2 shows a circuit of the liquid crystal display device. The liquid crystal display device includes a liquid crystal panel 100 in which m×n display pixels PX (=PX11 to PXmn) are arranged in a matrix, and a display control unit 200 for controlling the liquid crystal panel 100. For example, in the case where the liquid crystal panel 100 has an effective display area of 7-inch diagonal at an aspect ratio of 9:16, the number m of rows of the display pixels PX is set to 234, and the number n of columns of the display pixels PX is set to 1440. Each row of display pixels PX constitutes 480 RGB color display elements each of which includes three adjacent display pixels allocated to red, green and blue.

Figure 3:
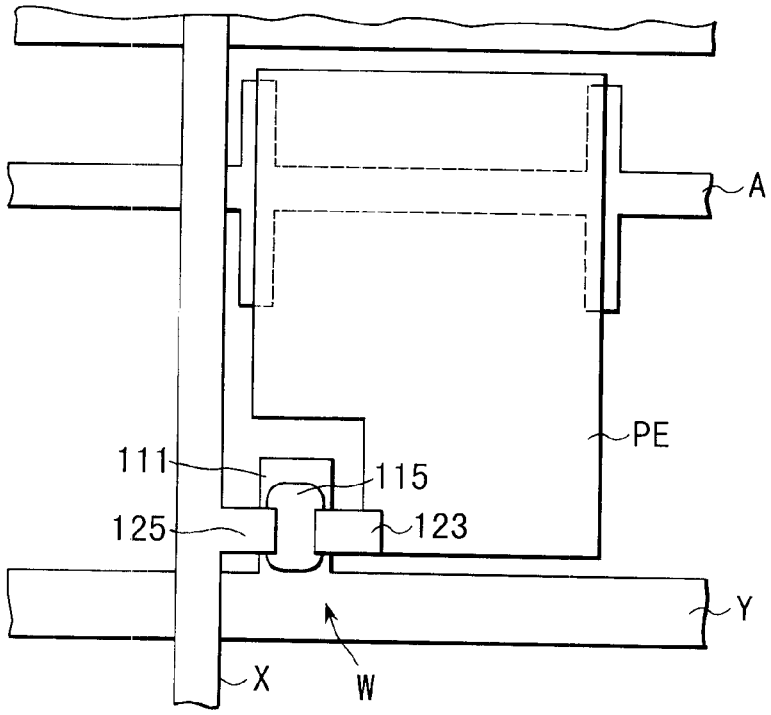
FIG. 3 is a top plan view showing a structure of a display pixel shown in FIG. 2.
Figure 4:
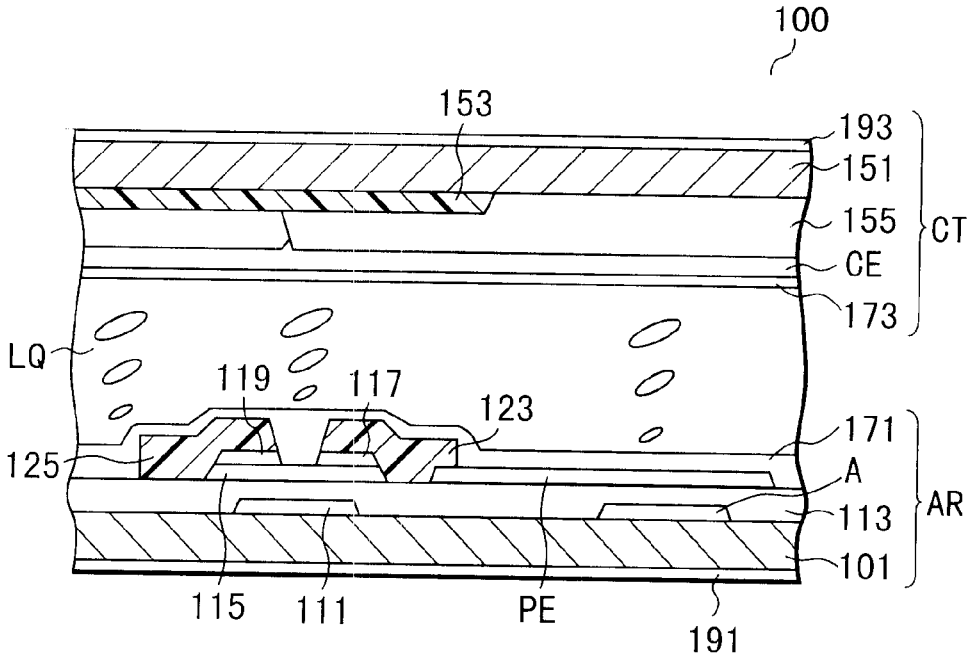
FIG. 4 is a cross sectional view showing structure of the display pixel shown in FIG. 3.

Further, the liquid crystal panel 100 has a structure in which a liquid crystal layer LQ is held between an array substrate AR and a counter substrate CT. As shown in FIG. 2, the array substrate AR has m×n pixel electrodes PE (=PE11 to PEmn) arranged in a matrix, m scanning lines Y (=Y1 to Ym) formed along rows of the pixel electrodes PE, n signal lines X (=X1 to Xn) formed along columns of the pixel electrodes PE, and m x n thin film transistors W (=W11 to Wmn) located in the vicinity of intersections between the signal lines X1 to Xn and scanning lines Y1 to Ym. Each thin film transistor W constitutes a switching element, which is turned on in response to a scanning pulse from a corresponding scanning line to apply a signal voltage from a corresponding signal line to a corresponding pixel electrode PE. Further, as shown in FIG. 3, the array substrate AR has n storage capacitance lines A each of which is formed to be insulated from and extend across the pixel electrodes PE of a corresponding row. As shown in FIG. 4, the counter substrate CT has a single counter electrode CE that faces the pixel electrodes PE. The counter electrode CE is electrically connected to the storage capacitance line A. Each display pixel PX is constructed using the pixel electrode PE, the counter electrode CE and the liquid crystal layer LQ, and is set to have a transmittance corresponding to a potential difference between the pixel electrode PE and the counter electrode CE.

The display control unit 200 has a scanning line driver 22 for driving the scanning lines Y1 to Ym, a signal line driver 24 for driving the signal lines X1 to Xn, and a drive controller 26 for controlling operation timings of the scanning line driver 22 and the signal line driver 24. The scanning line driver 22 is composed of two TAB-IC modules 22A and 22B which are fixed to one end of the array substrate AR substantially parallel to the columns of pixel electrodes PE. The IC module 22A is connected to the scanning lines Y1 to Y(m/2), and the IC module 22*b* is connected to the scanning lines Y(m/2+1) to Ym. On the other hand, the signal line driver 24 is composed of four TAB-IC modules 24A, 24B, 24C and 24D which are fixed to another end of the array substrate AR substantially parallel to the rows of pixel electrodes PE. The IC module 24A is connected to the signal line X1 to X(n/4), the IC module 24B is connected to the signal lines X(n/4+1) to X(2n/4), the IC module 24C is connected to the signal lines X(2n/4+1) to X(3n/4), and the IC module 24D is connected to the signal lines X(3n/4+1) to Xn, respectively.

The controller 26 receives a color video signal, a video synchronization signal and a mode control signal supplied externally, and then, generates a horizontal start signal STH, a horizontal clock signal CPH, a vertical start signal STV, a vertical clock signal CPV and analog RGB video signals DR, DG and DB, which have been conventionally known. In this case, the vertical start signal STV is a pulse generated for each frame, and the vertical clock signal CPV is a clock pulse which is generated in vertical clock cycles determined according to one horizontal scanning period in a normal display mode. Moreover, the horizontal start signal STH is a pulse generated every one horizontal scanning period, and the horizontal clock signal CPH is a clock pulse, which is generated in horizontal clock cycles determined according to one horizontal scanning period in a normal display mode. Further, the controller 26 generates output enable signals OE1, OE2 and OE3 of a negative logic for controlling an output operation of the scanning line driver 22. The RGB video signals DR, DG and DB, the horizontal start signal STH and the horizontal clock signal CPH are supplied to the signal line driver 24. The vertical start signal STV, the vertical clock signal CPV and the output enable signals OE1, OE2 and OE3 are supplied to the scanning line driver 22.

In the case of driving two scanning lines together in a zoom display mode, two clock pulses are generated as the vertical clock signal CPV during one horizontal scanning period. In the normal display mode, one of the output enable signals OE1, OE2 and OE3 is made active every one horizontal scanning period so as to drive three scanning lines Y in three horizontal scanning periods. In the zoom display mode, one or two of the output enable signals OE1, OE2 and OE3 is made active every one horizontal scanning period so as to drive four scanning lines Y in three horizontal scanning periods.

Subsequently, a structure of the liquid crystal panel 100 will be described in detail with reference to FIGS. 3 and 4. The array substrate AR has a glass substrate 101 as a support member for components such as the thin film transistor W, the pixel electrode PE, the scanning line Y, the signal line X, the storage capacitance line A or the like. The counter substrate CT has a glass substrate 151 as a support member for components such as the counter electrode CE, a light shield film 153 or the like. The glass substrates 101 and 151 have a thickness of about 0.7 mm. The thin film transistor w is an inverted staggered type transistor having the following construction. More specifically, the inverted staggered type transistor comprises: a gate electrode 111 which is integrated with the scanning line Y formed on the glass substrate 101; a non-crystal silicon (a-Si:H) active layer 115 which is formed on an insulation film 113 covering the gate electrode 111; ohmic contact layers 117 and 119 of $n^+$ type a-Si:H which are formed on the active layer 115 and separated from each other; a source electrode 123 which is formed on the ohmic contact layer 117; and a drain electrode 125 which is formed on the ohmic contact layer 119. The source electrode 123 is connected to the pixel electrode PE, and the drain electrode 125 is connected to the signal line X. The pixel electrode PE is formed of an ITO (Indium Thin Oxide) and surrounded by two adjacent scanning lines Y and two adjacent signal lines X. The storage capacitance line A is arranged substantially parallel to the scanning line Y, and is insulated from the pixel electrode PE by the insulation film 113. The light shield layer 153 is formed on the glass substrate 151 to expose an area facing the pixel electrode PE of the display pixel PX and shield a gap between the pixel electrode-PE and the signal line X, a gap between the pixel electrode PE and the scanning line Y, and the thin film transistor W. A color filter 155 is formed on the exposed area of the glass substrate 151 and the light shield layer 153 so as to have a color allocated to the display pixel PX. The counter electrode CE is formed on the color filter 15 so as to face m×n pixel electrodes PE. The components formed on the glass substrate 101 is entirely covered by an alignment layer 171 contacting with the liquid crystal layer LQ; on the other hand, the components formed on the glass substrate 151 is entirely covered by an alignment layer 173 contacting with the liquid crystal layer LQ. Moreover, the array substrate AR has polarizer films 191 and 193 affixed individually to the glass substrates 101 and 151 on a side opposite to the liquid crystal layer LQ. The liquid crystal layer LQ is composed of a TN (Twisted Nematic) liquid crystal, and causes the liquid crystal panel 100 to have an operation characteristic of a normally white mode in combination with the polarizer films 191 and 193.

Figure 5:
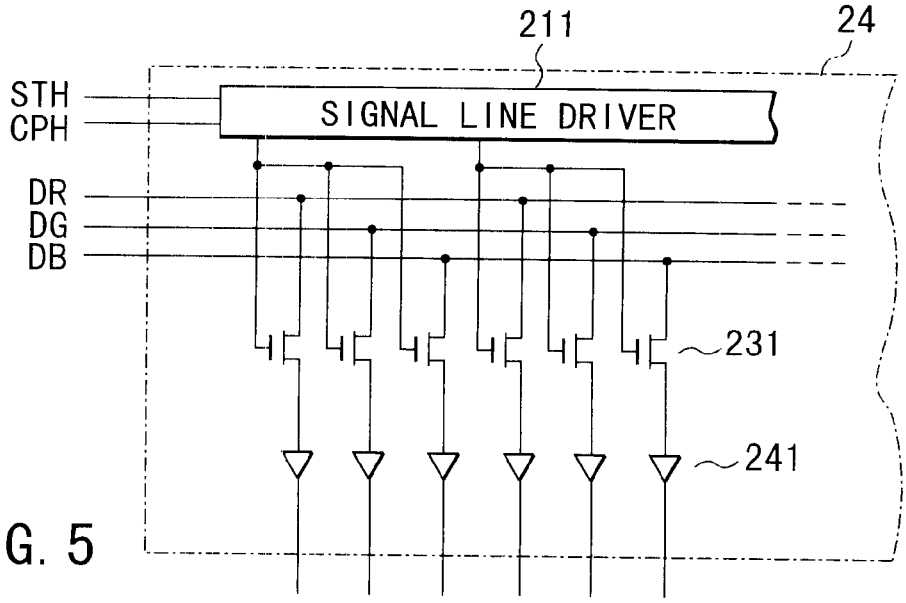
FIG. 5 is a circuit diagram showing a signal line driver.

FIG. 5 shows a circuit construction of the signal line driver 24. For example, the signal line driver 24 includes a shift register 211, n analog switches 231, and n output buffers 241. More specifically, the shift register 211 sequentially shifts the horizontal start signal STH in synchronization with the horizontal clock signal CPH. Each analog switch 231 samples a corresponding one of the RGB video signals DR, DG and DB in response to an output signal obtained from a corresponding one of n/3 parallel output terminals of the shift register 211. Each output buffer 241 outputs a voltage level sampled by a corresponding analog switch 231 as a pixel voltage signal to a corresponding one of the signal lines X1 to Xn. The n analog switches 231 are divided into switch groups each including three adjacent analog switches 231 which are allocated to the RGB video signals DR, DG and DB and controlled by a corresponding output signal of the shift register 211. The adjacent analog switches 231 of each switch group simultaneously sample the RGB video signals DR, DG and DB in order to drive three adjacent signal lines X.

Figure 6:
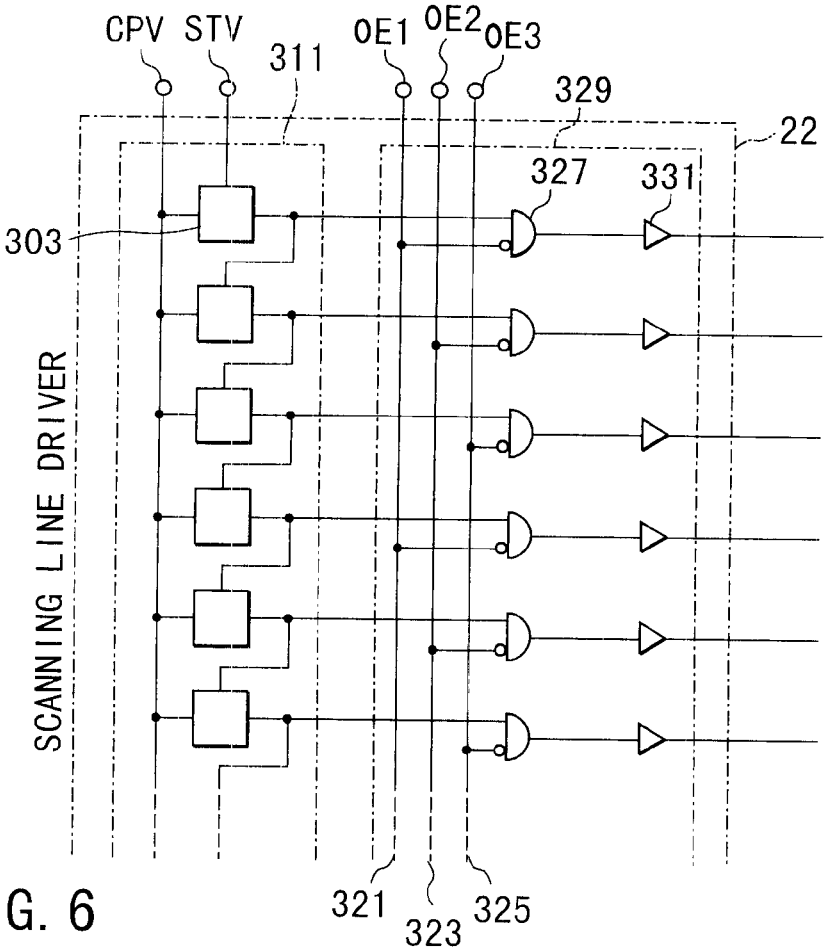
FIG. 6 is a circuit diagram showing a scanning line driver shown in FIG. 2.

FIG. 6 shows a circuit construction of the scanning line driver 22. The scanning line driver 22 has a shift register 311 and an output circuit 329. The shift register 311 is composed of m flip-flops 303 connected in cascade, and shifts the vertical start signal STV to one direction in synchronization with the vertical clock signal CPV, and then, sequentially outputs the signal from output terminals of the flip-flops 303. On the other hand, the output circuit 329 is composed of m AND circuits 327 and m output buffers 331, and outputs output signals of the flip-flops 303 as a scanning pulse VG to the scanning lines Y1 to Ym on the basis of the output enable signals OE1, OE2 and OE3. Non-inverting input terminals of the AND circuits 327 are connected to the output terminals of the flip-flops 303; on the other hand, inverted input terminals of the AND circuits 327 are selectively connected to control signal buses 321, 323 and 325 which receive the output enable signals OE1, OE2 and OE3. More specifically, the m AND circuits 327 are divided into m/3 groups each composed of three adjacent AND circuits 327, and control signal buses 321, 323 and 325 are connected to inverted input terminals of the three adjacent AND circuits 327 of each group. The output terminals of the m AND circuits 327 are connected to the scanning lines Y1 to Ym via the m output buffers 331.

Figure 7:
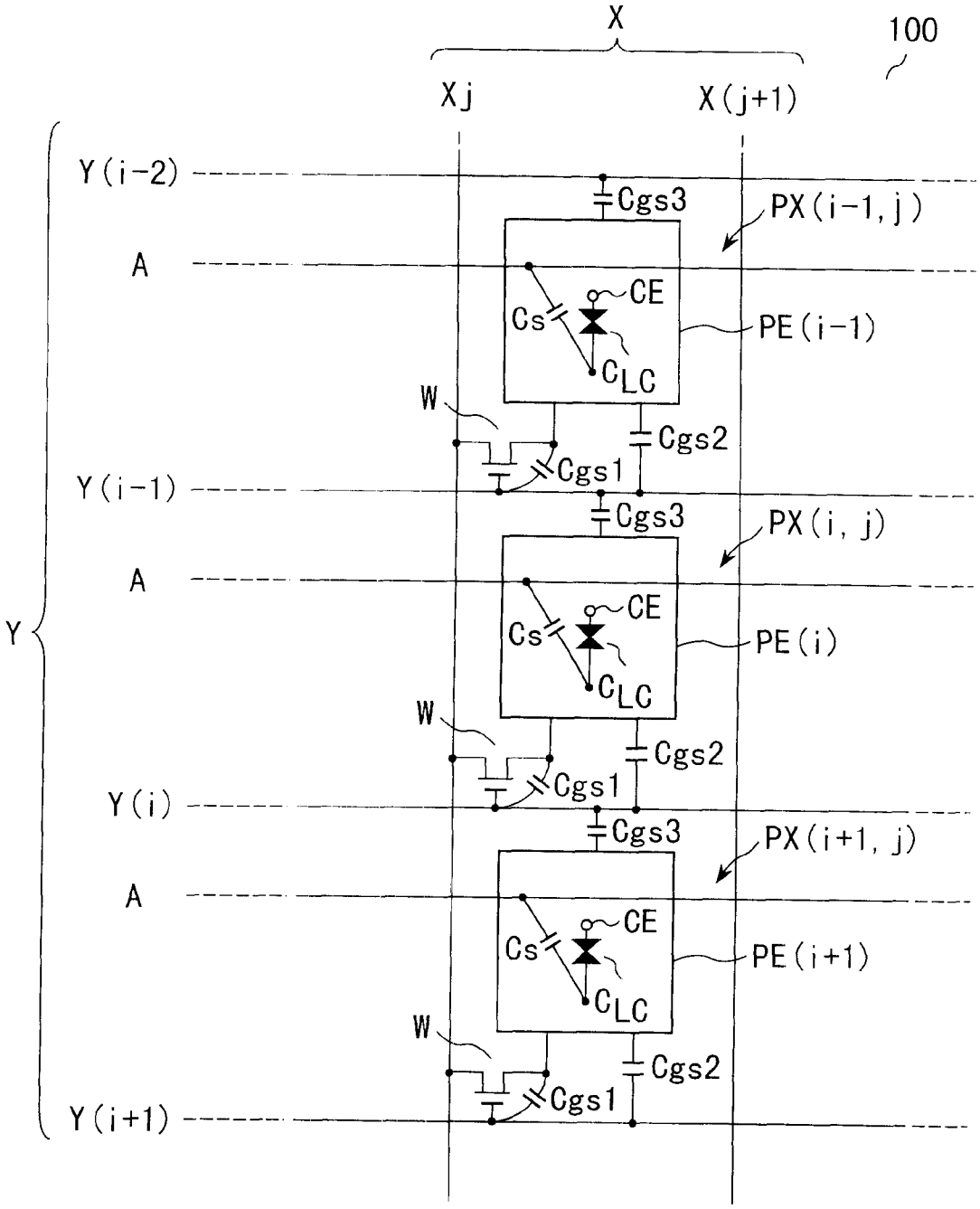
FIG. 7 is a view showing equivalent circuits of first to third display pixels adjacent to each other in a column direction.
Figure 8:
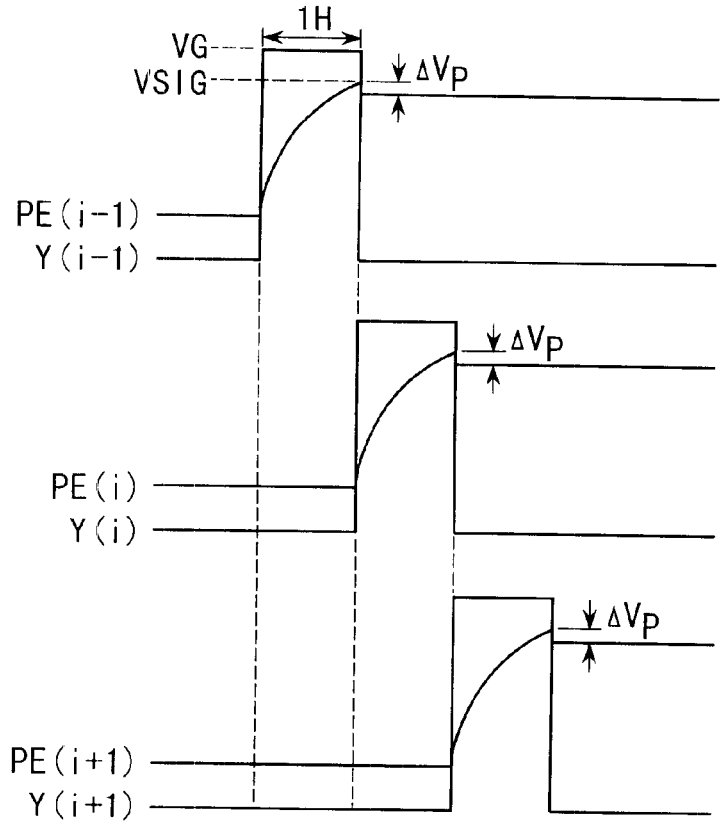
FIG. 8 is a waveform chart showing transitions of pixel potentials obtained in the case where three scanning lines shown in FIG. 7 are sequentially driven.
Figure 9:
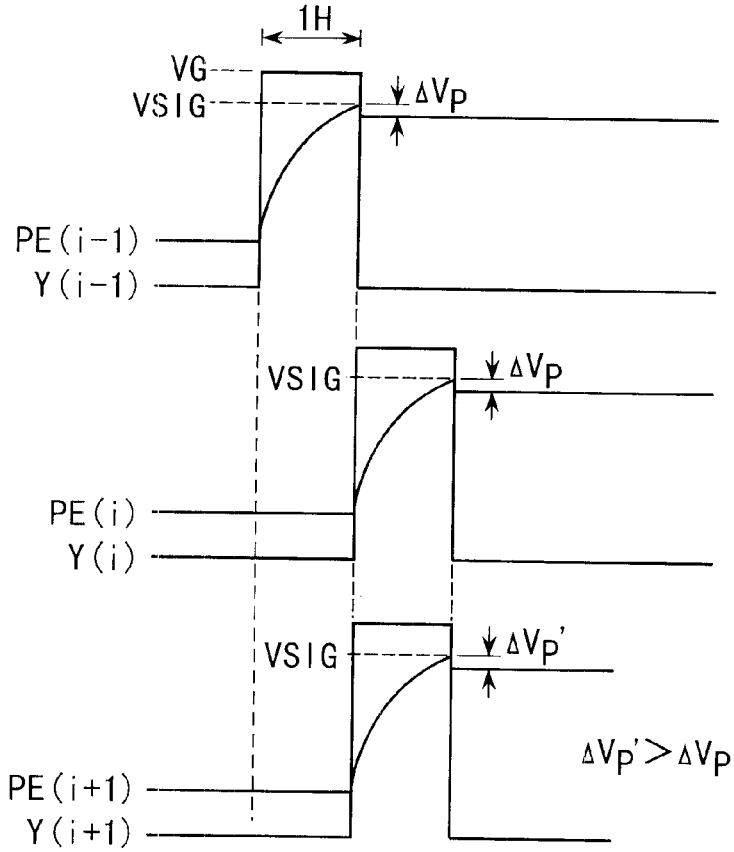
FIG. 9 is a waveform chart showing transitions of pixel potentials obtained in the case where two of three scanning lines shown in FIG. 7 are driven together.

Now will be described a factor which may cause a display quality to be lowered when a plurality of scanning Lines Y are driven together in a zoom display mode, with reference to FIG. 7 to FIG. 9. FIG. 7 shows adjacent three display pixels PX(i−1, j), PX (i, j) and PX(i+1, j) arbitrarily selected in a column direction of the liquid crystal panel 100. In the display pixel PX (i, j), the thin film transistor w is driven by the scanning pulse VG supplied via a scanning line Y(i) so as to apply a signal voltage VSIG of a signal line Xj to a pixel electrode PE(i). In FIG. 7, CLC is a liquid crystal capacitance between the pixel electrode PE(i) and the counter electrode CE, and Cs is a storage capacitance between the pixel electrode PE(i) and the corresponding storage capacitance line A. Moreover, Cgs 1 is a parasitic capacitance between a gate of the thin film transistor w and a source thereof, Cg2 is a parasitic capacitance between the pixel electrode PE(i) and the adjacent scanning line Y(i), and Cg3 is a parasitic capacitance between the pixel electrode PE(i) and the adjacent scanning line Y(i−1). Likewise, the above display pixels PX(i−1, j) and PX(i+1, j) have the same construction as described above.

The thin film transistor W is turned on for a period from a rise to a fall of the scanning pulse VG. The potential of the pixel electrode PE(i) is changed to be equal to that of the signal line Xj by a charge supplied during a period that the thin film transistor W is kept conductive. When the thin film transistor W is made nonconductive upon fall of scanning pulse VG, a charge on the pixel electrode PE(i) is redistributed due to an influence of the parasitic capacitance Cgs1 and Cgs2, thereby causing the potential level of the pixel electrode PE(i) to be shifted.

In the normal display mode; the scanning pulse VG is sequentially supplied to the scanning lines Y(i−1), Y(i), and Y(i+1) for each horizontal scanning period (1H). In the case where the thin film transistor W is n-channel type, as shown in FIG. 8, the potential of each of the display electrodes PE(i−1), PE(i) and PE(i+1) is shifted from the level of the signal line potential VSIG toward the negative polarity side upon rise of the scanning pulse VG.

A shifted level amount ΔVp is expressed by the following equation (1).

$$\Delta Vp=\{(Cgs1+Cgs2)/(CLC+Cs+Cgs1+Cgs2+Cgs3)\}\Delta VG \quad (1)$$

where, ΔVG is an amplitude of the scanning pulse VG.

By the way, in the zoom display mode, for example, the adjacent scanning lines Y(i) and Y(i+1) are driven during the identical horizontal scanning period in order to apply the signal line potential VSIG commonly to the pixel electrodes PE(i) and PE(i+1). In this case, as shown in FIG. 9, the pixel potential of the pixel electrodes PE(i) is shifted in its level according to the above equation (1) after fall of the scanning pulse VG supplied to the scanning line Y(i). However, the pixel potential of the pixel electrode PE(i+1) is not shifted in its level according to the above equation (1) after fall of the scanning pulse VG supplied to the signal line Y(i+1). This is caused by a difference in arrangement conditions between the pixel electrodes PE(i) and PE(i+1). More specifically, the pixel electrode PE(i) is capacitively coupled to the scanning lines Y(i−1) and Y(i), and the pixel electrode, PE(i+1) is capacitively coupled to the scanning lines Y(i) and Y(i+1). Thus, the scanning pulse VG is supplied to the scanning lines Y(i) and Y(i+1), and is not supplied to the scanning line Y(i−1). For this reason, the pixel potential of the pixel electrode PE(i) receives almost no influence of the parasitic capacitance Cgs3 between the pixel electrode PE(i) and the scanning line Y(i−1). On the contrary, the pixel potential of the pixel electrode PE(i+1) receives an influence of the parasitic capacitance Cgs3 between the pixel electrode PE(i+1) and the scanning lines Y(i), in addition to the parasitic capacitance Cgs2 between the pixel electrode PE(i+1) and the scanning line Y(i+1).

Thus, a shifted level amount ΔVp' of the pixel electrode PE(i+1) is expressed by the following equation (2).

$$\Delta Vp'=\{(Cgs1+Cgs2+Cgs3)/(CLC+Cs+Cgs1+Cgs2+Cgs3)\}\Delta VG \quad (2)$$

According to the above equations (1) and (2), it can be seen that, in the case where the scanning lines Y(i) and Y(i+1) are driven together, the pixel potential of the pixel electrode PE(i+1) is shifted in its level larger than the pixel potential of the pixel electrode PE(i) after fall of the scanning pulse VG, thereby causing the display quality to be lowered.

Figure 10:
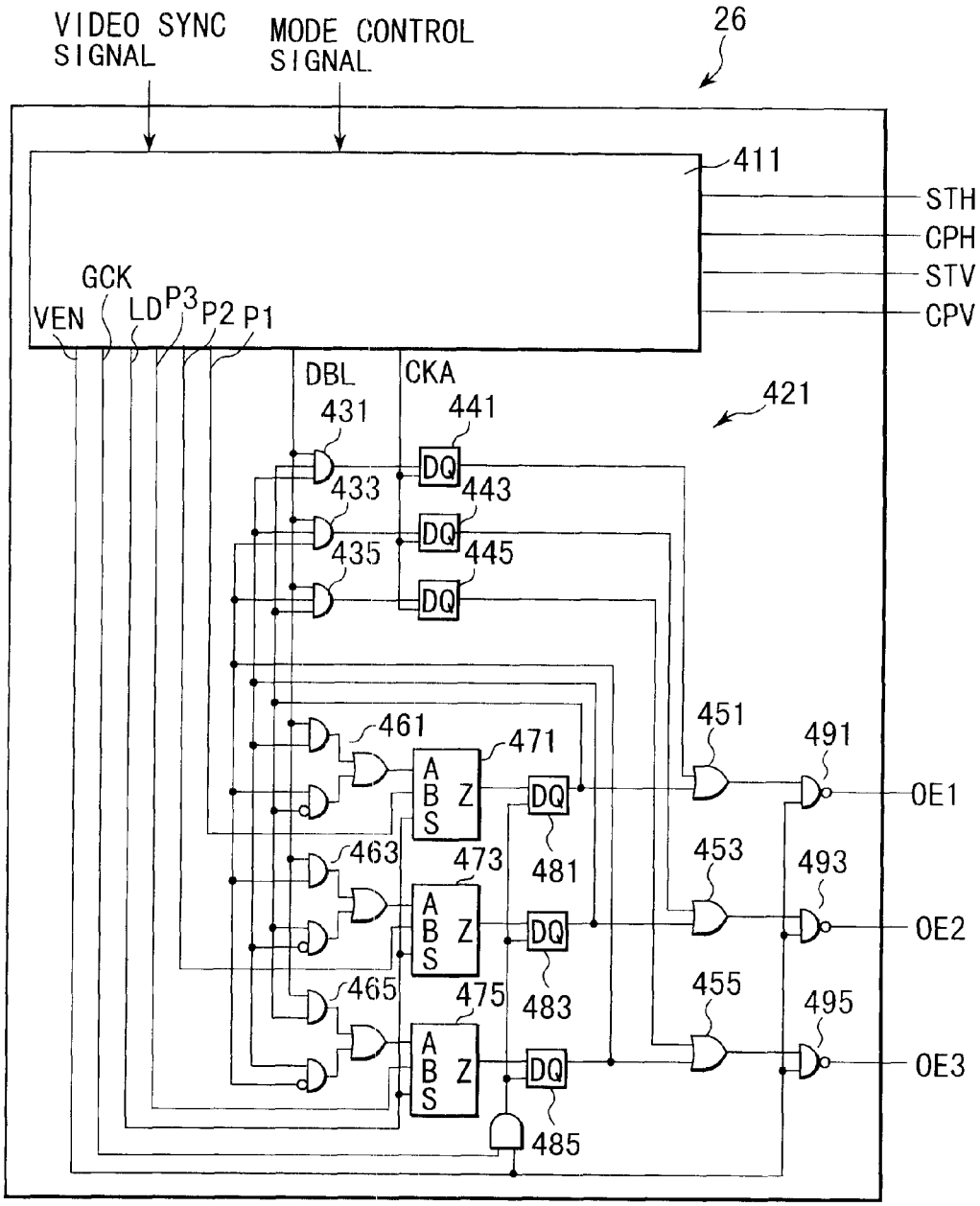
FIG. 10 is a circuit diagram of a controller shown in FIG. 2.

FIG. 10 shows a circuit construction of the controller 26. The controller 26 has a timing signal generator 411 and a scanning controller 421. The timing signal generator 411 has a structure conventionally known and generates a horizontal start signal STH, a horizontal clock signal CPH, a vertical start signal STV and a vertical clock signal CPV on the basis of a color video signal, a video synchronization signal and a mode control signal, which are supplied externally. Further, on the basis of the above signals, the timing signal generator 411 generates internal control signals such as a CPV enable signal VEN, a scanning pulse fall timing signal GCK, a load signal LD, setting signals P1, P2 and P3, a scanning setting signal DBL, and an elimination timing signal CKA. The scanning setting signal DBL is maintained at a low level in the case where the normal display mode is designated by the mode control signal, and maintained at a high level in the case where the zoom display mode is designated by the mode control signal.

The scanning controller 421 generates output enable signals OE1, OE2 and OE3 on the basis of internal timing signals VEN, GCK, LD, P1, P2, P3, DBL and CKA supplied from the timing signal generator 411. The enable signal OE1, OE2 and OE3 are generated so as to cancel a difference between the potentials of the adjacent pixel electrodes PE to be shifted in levels upon falls of the scanning pulses VG supplied to the two adjacent scanning lines Y in the zoom display mode.

Further, the scanning controller 421 is composed of: AND circuits 431, 433 and 435; AND-OR circuits 461, 463 and 465; counters 471, 473 and 475; one-bit registers 481, 483 and 485, OR circuits 451, 453 and 455; and NAND circuits 491, 493 and 495. The scanning setting signal DBL is input to the AND circuits 431, 433 and 435, output signals of the AND circuits 431, 433 and 435 are supplied to the one-bit registers 481, 483 and 485. The one-bit registers 481, 483 and 485 latch the output signals in response to the elimination timing signal CKA, and supply them to the OR circuits 451, 453 and 455. Output signals of the AND-OR circuits 461, 463 and 465 and the setting signals P1, P2 and P3 are supplied to the counters 471, 473 and 475, respectively. The counters 471, 473 and 475 perform a count operation in response to the scanning pulse fall timing signal GCK, and supply the results to the one-bit registers 481, 483 and 485. The one-bit registers 481, 483 and 485 latch the output results in response to a logical sum of the CPV enable signal VEN and the scanning pulse fall timing signal GCK, and supply them to the OR circuits 451, 453 and 455 and back to input terminals of the AND-OR circuits 461, 463 and 465. The NAND circuits 491, 493 and 495 output signals of the OR circuits 451, 453 and 455 as the output enable signals OE1, OE2 and OE3 of a negative logic in an effective horizontal scanning period where the CPV enable signal VEN is maintained at a high level.

An operation of the liquid crystal display device will be described below. The controller 26 controls the scanning line driver 22 and the signal line driver 24 on the basis of a video signal, a video synchronization signal and a mode control signal, which are supplied externally. In the controller 26, the timing signal generator 411 converts a color video signal into analog RGB video signals DR, DG and DB, and generates a horizontal start signal STH and a horizontal clock signal CPH on the basis of the video synchronization signal. The horizontal start signal STH and horizontal clock signal CPH are supplied to the signal line driver 24 together with the analog RGB video signals DR, DG and DB. In the signal line driver 24, the shift register 211 successively shifts the horizontal start signal STH in synchronization with the horizontal clock signal CPH, and n analog switches 231 sample the RGB video signals DR, DG and DB in response to output signals obtained from n/3 parallel output terminals of the shift register 211. Further, the n output buffers 241 output voltage levels sampled by the analog switches 231 as pixel voltage signals to the signal lines X1 to Xn.

Figure 11:
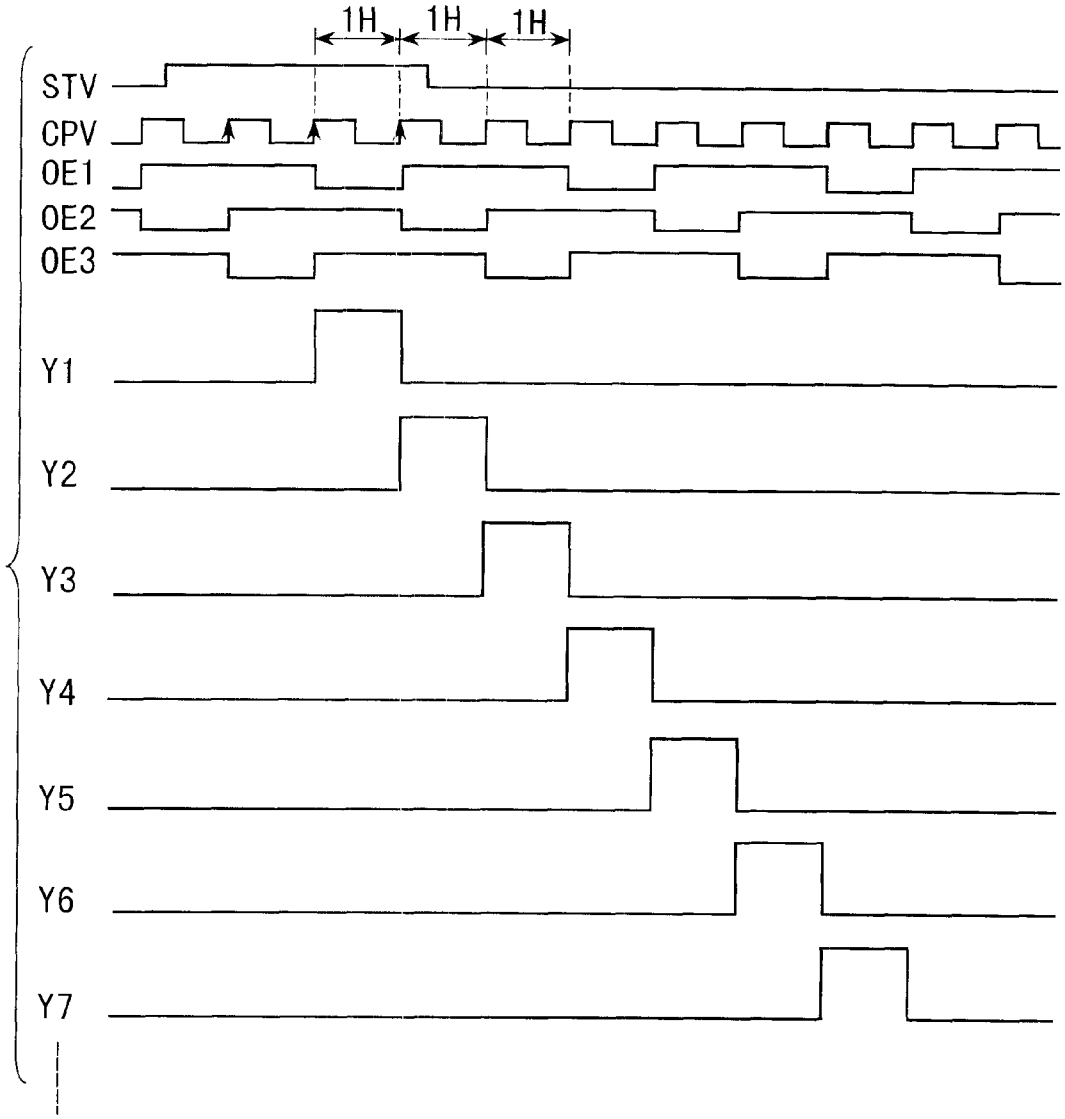
FIG. 11 is a time chart showing a normal display mode operation of the scanning line driver shown in FIG. 6.

In the case where the normal display mode is designated by the mode control signal, the timing signal generator 411 generates a vertical start signal STV and a vertical clock signal CPV as shown in FIG. 11 for the normal display mode together with internal timing signals VEN, GCK, LD, P1, P2, P3, DBL and CKA. The scanning controller 421 generates output enable signals OE1, OE2 and OE3 on the basis of the internal timing signals VEN, GCK, LD, P1, P2, P3, DBL and CKA. Since the scanning setting signal DBL is maintained at a low level, the output enable signals OE1, OE2 and OE3 have waveforms shown in FIG. 11. The vertical start signal STV and vertical clock signal CPV are supplied to the scanning line driver 22 together with the output enable signals OE1, OE2 and OE3. In the scanning line driver 22, the shift register 311 shifts the vertical start signal STV to one direction in synchronization with the vertical clock signal CPV, and sequentially outputs the signal from the output terminals of the flip-flops 303. The output circuit 329 outputs the output signals of the flip-flops 303 as the scanning pulse VG to the scanning lines Y1 to Ym on the basis of the output enable signals OE1, OE2 and OE3. Namely, the scanning lines Y1 to Ym are sequentially driven every horizontal scanning period.

Figure 12:
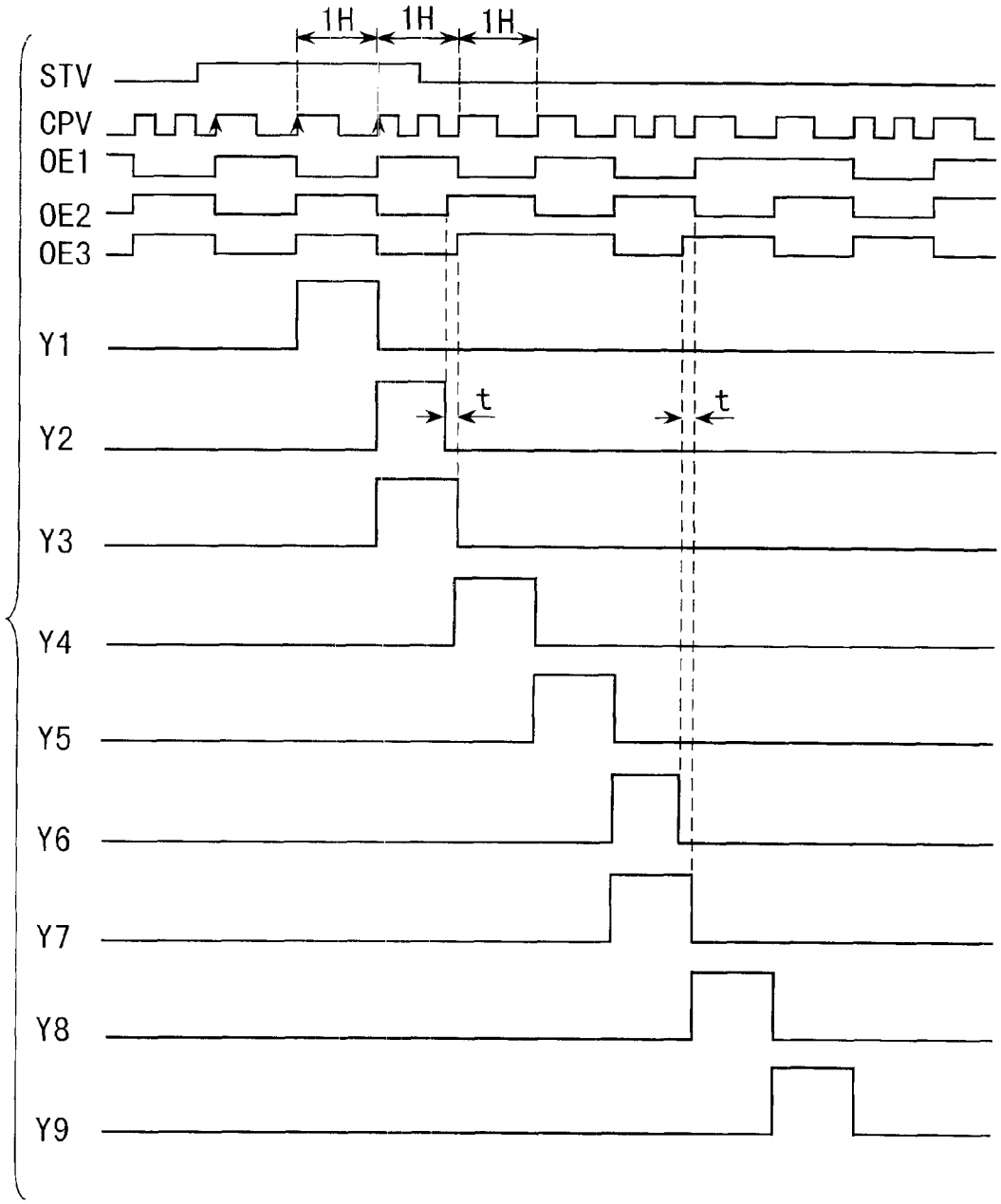
FIG. 12 is a time chart showing a zoom display mode operation-of the scanning line driver shown in FIG. 6.
Figure 13:
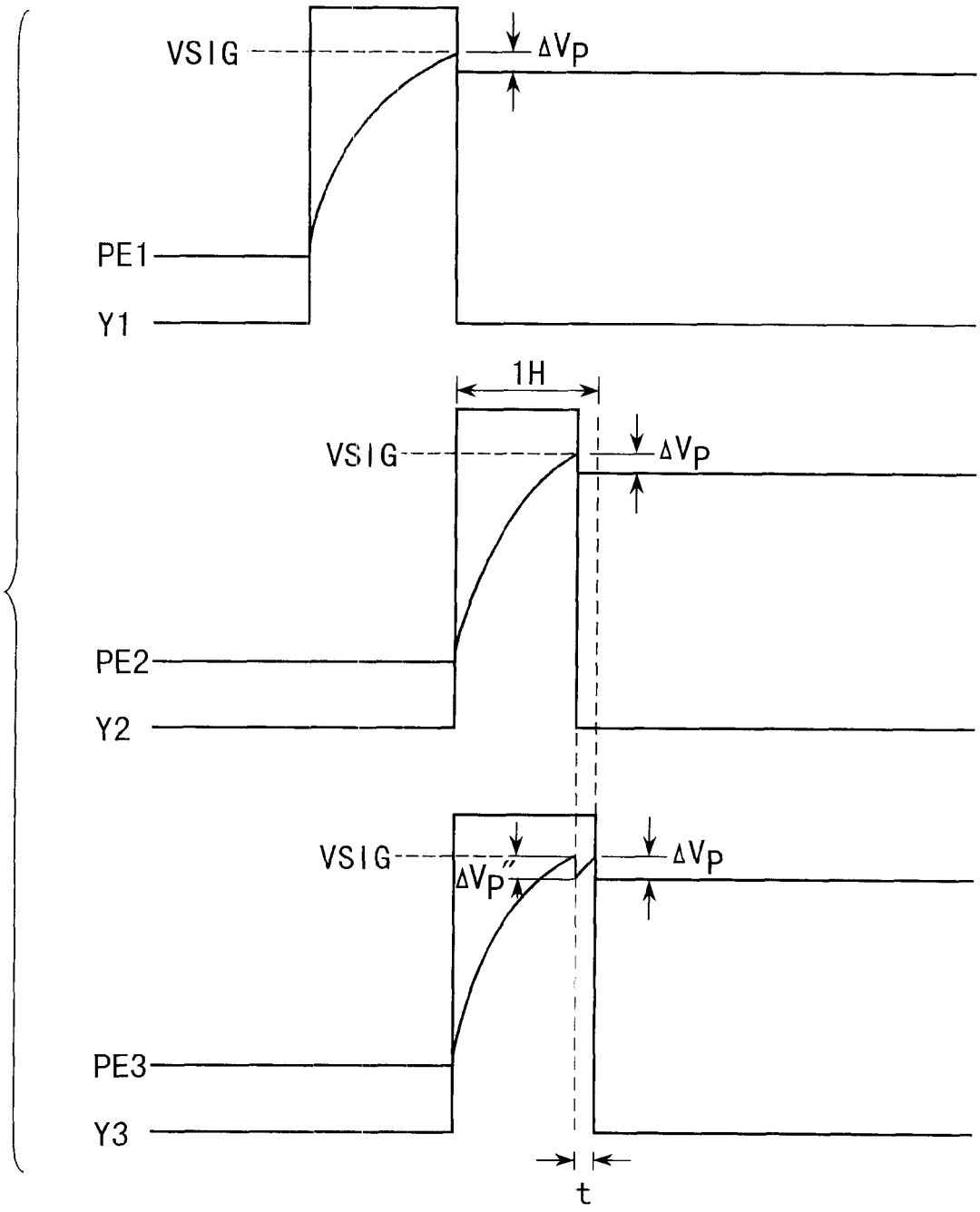
FIG. 13 is a waveform chart showing transitions of pixel potentials obtained in the case where two of three scanning lines shown in FIG. 12 are driven together.

On the other hand, in the case where the zoom display mode is designated by the mode control signal, the timing signal generator 411 generates a vertical start signal STV and a vertical clock signal CPV as shown in FIG. 12 for zoom display mode together with internal timing signals VEN, GCK, LD, P1, P2, P3, DBL and CKA. The scanning controller 421 generates output enable signals OE1, OE2 and OE3 on the basis of the internal timing signals VEN, GCK, LD, P1, P2, P3, DBL and CKA. Since the scanning setting signal DBL is maintained at a high level, the output enable signals OE1, OE2 and OE3 have waveforms shown in FIG. 12. The vertical start signal STV and vertical clock signal CPV are supplied to the scanning line driver 22 together with the output enable signals OE1, OE2 and OE3. In the scanning line driver 22, the shift register 311 shifts the vertical start signal STV to one direction in synchronization with the vertical clock signal CPV, and sequentially outputs the signal from the output terminals of the flip-flops 303. The output circuit 329 outputs the output signals of the flip-flops 303 as the scanning pulse VG to the scanning lines Y1 to Ym on the basis of the output enable signals OE1, OE2 and OE3. Namely, the scanning lines Y1 to Ym are sequentially driven for each horizontal scanning period. Accordingly, the scanning pulse GV is supplied to one or two of the scanning lines Y1 to Ym every horizontal scanning period. In FIG. 12, the scanning pulse GV is supplied to the scanning line Y1 in a first horizontal scanning period, is supplied to the scanning lines Y1 and Y2 in a second horizontal scanning period, and is supplied to the scanning line Y4 in a third horizontal scanning period. Regarding the other scanning lines Y4 to Ym, the scanning pulse GV is supplied to them in a cycle corresponding to three horizontal scanning periods in the manner described above. Namely, the scanning lines Y1 to Ym are driven in a ratio of four to three horizontal scanning periods.

In the zoom display mode, as shown in FIG. 12, the output enable signals OE2 and OE3 are simultaneously made active at the start timing of the second horizontal scanning period so as to drive the scanning lines Y2 and Y3 by the scanning pulse VG. The output enable signal OE2 is made non-active earlier than an end timing of the horizontal scanning period by an elimination period t (=5 μsec), and the output enable signal OE3 is made non-active at the end timing of the horizontal scanning period. The scanning line Y2 is driven by the scanning pulse VG continuously supplied for the period where the output enable signal OE2 is active, and the scanning line Y3 is driven by the scanning pulse VG continuously supplied for the period where the output enable signal OE3 is active. Therefore, the scanning pulse VG falls earlier than the scanning line Y3 in the scanning line Y2.

The potentials of the pixel electrodes PE2 and PE3 rises up to the signal line potential VSIG by the thin film transistors w which are simultaneously turned on upon rises of the scanning pulses VG supplied to the scanning lines Y2 and Y3 in the second horizontal scanning period. When the scanning pulse VG falls in the scanning line Y2, the thin film transistor W for the pixel electrode PE2 becomes nonconductive. Depending upon change in the potential of the scanning line Y2, the pixel potential of the pixel electrode PE2 is shifted by ΔVp in its level from the signal line potential VSIG toward the negative polarity side. At this time, the scanning pulse VG does not fall in the scanning line Y3. The thin film transistor W for the pixel electrode PE3 does not become nonconductive. Accordingly, the pixel potential of the pixel electrode PE3 is temporarily shifted by ΔVp" in its level from the signal line potential VSIG to the negative polarity side depending upon change in the potential of the scanning line Y2, and resumed to the signal line potential VSIG before the end of the second horizontal scanning period.

In this case, a shifted level amount ΔVp" is expressed by the following equation (3).

$$\Delta Vp''=\{(Cgs3)/(CLC+Cs+Cgs1+Cgs2+Cgs3)\}\Delta VG \quad (3)$$

The thin film transistor W for the pixel electrode PE3 becomes nonconductive when the scanning pulse VG falls at the end timing of the second horizontal scanning period. Whereby the pixel potential of the pixel electrode PE3 is shifted by ΔVp in its level from the signal line potential VSIG to the negative polarity side depending upon change in the potential of the scanning line Y3. In other words, the pixel potential of the pixel electrode PE3 is approximately coincident with the pixel potential of the pixel electrode PE2 after the second horizontal scanning period.

In the liquid crystal display device of this embodiment, the shifted level amounts are made uniform by providing different driving end timings for the scanning lines driven during the identical horizontal scanning period. Therefore, irregularity in brightness can be prevented between the display pixels PX, so that a preferable display quality can be secured.

Moreover, in the liquid crystal display device of this embodiment, the liquid crystal capacitance CLC has a value of 0.2 pF in a state that no voltage is applied thereto, and the storage capacitance Cs has a value of 0.3 pF less than two times of the liquid crystal capacitance CLC. As described above, even if the storage capacitance Cs is a small value, a preferable display quality can be secured. In fact, by using an storage capacitance which is substantially 1.5 times of the liquid crystal capacitance CLC, a sufficient aperture ratio can be obtained to improve a light utilization efficiency of liquid crystal display device.

By the way, in this embodiment, the scanning pulse VG has a pulse width of about 63 μsec. The elimination period t is set to 5 μsec with respect to the pulse width. When the elimination period t exceeds 15 μsec, the pixel potential of the pixel electrode PE2 does not rise up to the signal line potential before the thin film transistor W for the pixel electrode PE2 becomes nonconductive. Moreover, when the elimination period t is smaller than 3 μsec, the pixel potential of the pixel electrode PE3 does not again rise up to the signal line potential after it is temporarily lowered due to the thin film transistor W for the pixel electrode PE2 made nonconductive. When the elimination period t is set to a range from 3 to 15 μsec, it is possible to prevent irregularity in brightness occurring-in the conventional case. Generally, such an elimination period t depends upon the pulse width of the scanning pulse VG. Therefore, it is preferable that the elimination period t is set to a range from 5% to 20% of the pulse width of the scanning pulse VG.

The present invention is not limited to the above embodiment that two adjacent scanning lines Y are driven together in one horizontal scanning period of three horizontal scanning periods. For example, the number of scanning lines Y driven together and the driving cycle of the scanning lines Y may be properly selected for the magnification of an image.

Figure 14:
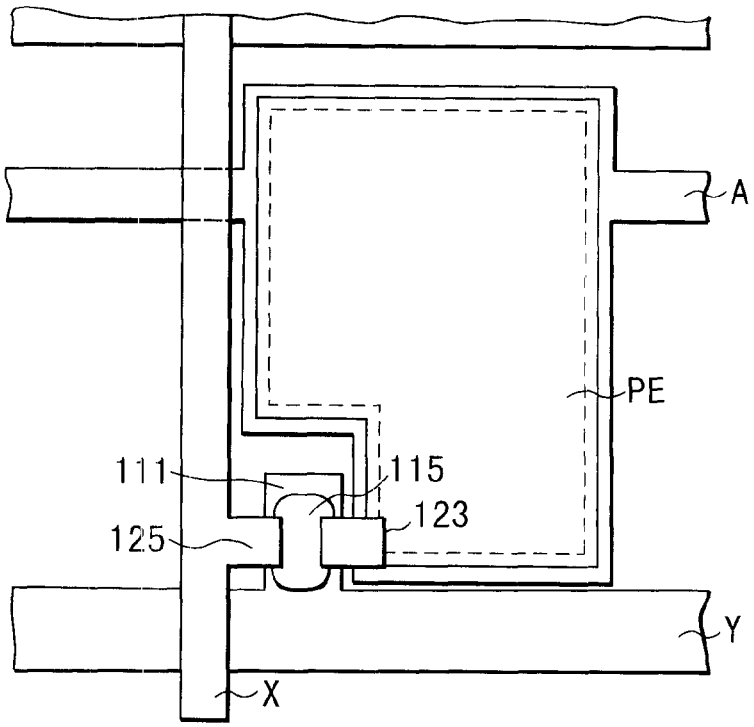
FIG. 14 is a top plan view showing a structure of a first modification of the display pixel shown in FIG. 3.
Figure 15:
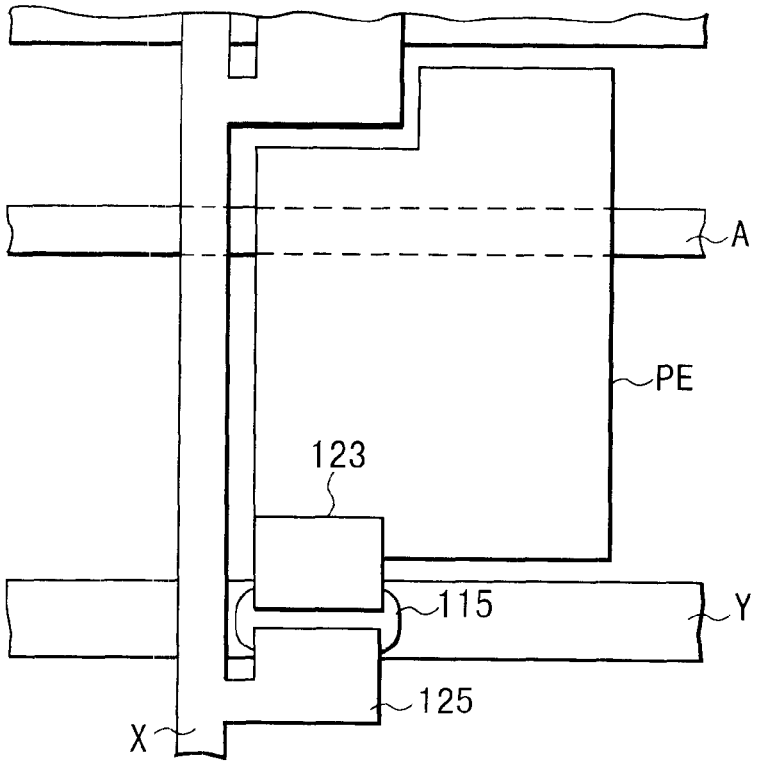
FIG. 15 is a top plan view showing a structure of a second modification of the display pixel shown in FIG. 3.

Moreover, in the case where the two adjacent scanning lines Y are composed of the first adjacent scanning line Y used for the pixel electrode PE arranged between the scanning lines, and the second adjacent scanning line Y not used for the pixel electrode PE, the elimination period t, that is, a resuming period for pixel potential can be shortened by an increase of the storage capacitance Cs or by a decrease of the parasitic capacitance Cgs3 between the pixel electrode PE and the second adjacent scanning line Y. Therefore, when the following structures are employed within an admitted range of aperture ratio, the elimination period t is effectively shortened. More specifically, the shield structures include a storage capacitance line shield structure of FIG. 14 in which the storage capacitance line A is disposed to extend into an area surrounding the pixel electrode PE, and a signal line shield structure of FIG. 15 in which the gate electrode of the thin film transistor (TFT) W is formed of the first adjacent scanning line Y extending straightly and the drain electrode of the thin film transistor W is formed of the signal line X extending into an area between the second adjacent scanning line Y and the pixel electrode PE. Further, the shield structures include a scanning line shield structure (not shown) in which the first adjacent scanning line Y is disposed to extend into an area between the pixel electrode PE and the second adjacent scanning line Y, and a shield structure (not shown) in which another shielding line is disposed to extend into an area between the pixel electrode PE and the second adjacent scanning line Y. In particular, when the gate electrode is formed of the first adjacent scanning line Y extending straightly to obtain the TFT-on-gate structure, it is possible to prevent significant increases of other undesirable parasitic capacitances which may cause an increase of the amount of the pixel potential level shifted when the thin film transistor W is made nonconductive. Moreover, the elimination period t can be effectively shortened by using the storage capacitance line A formed of a transparent electrode to obtain a large storage capacitance Cs, although the number of manufacturing processes increases.

Further, the present invention is applied to the zoom display mode in the embodiment described above. However, the present invention is also applicable to any display mode in which at least two adjacent scanning lines Y are driven together.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A flat-panel display device comprising:

a plurality of display pixels arranged in a matrix;

a plurality of scanning lines formed along rows of the display pixels;

a plurality of signal lines formed along columns of the display pixels;

a plurality of switching elements formed in the vicinity of intersections between the scanning lines and the signal lines and each driven via a corresponding scanning line to apply a potential of the corresponding signal line to a corresponding display pixel; and a display control unit for driving the scanning lines and the signal lines;

wherein said display control unit includes:

a scanning line driver for periodically selecting at least two adjacent scanning lines from the plurality of scanning lines to drive the adjacent scanning lines together; and a scanning controller for controlling said scanning line driver to turn on the switching elements connected to a first one of the adjacent scanning lines which is located on one side of a row of the display pixels capacitively coupled thereto and driven for the row of display pixels, and the switching elements connected to a second one of the adjacent scanning lines which is located on another side of the row of display pixels capacitively coupled thereto and not driven for the row of display pixels, at a substantially identical timing, and to turn off the switching elements connected to the second adjacent scanning line at an earlier timing than that for the switching elements connected to the first adjacent scanning line by a predetermined period.

2. A flat-panel display device according to claim 1, wherein the scanning line driver includes a shift register having a plurality of flip-flops connected-in cascade and an output section which outputs output signals of said flip-flops as a scanning pulse to the plurality of scanning lines, and the scanning controller is arranged to control pulse widths of the scanning pulses output to the first and second adjacent scanning lines from said output section.

3. A flat-panel display device according to claim 2, wherein said predetermined period is set to a range from 5% to 20% of the pulse width of the scanning pulse output to the first adjacent scanning line, and the pulse width of the scanning pulse output to the second adjacent scanning line is set shorter than the pulse width of the scanning pulse output to the first adjacent scanning line by the predetermined period.

4. A flat-panel display device according to claim 1, wherein said display control unit is constructed independently from a display panel which is composed of:

an array substrate on which said pixel electrodes are formed together with said scanning lines, said signal lines and said switching elements;

a counter substrate on which a counter electrode is formed to face said pixel electrodes; and a liquid crystal layer held between said array substrate and said counter substrate; each display pixel being formed of the counter electrode, the liquid crystal layer and the pixel electrode.

5. A flat-panel display device according to claim 4, wherein said array substrate includes a plurality of storage capacitance lines each of which is arranged substantially parallel to said scanning lines, faces the pixel electrodes of a corresponding row, and is insulated from the pixel electrodes of the corresponding row.

6. A flat-panel display device according to claim 5, wherein a storage capacitance between the storage capacitance line and the pixel electrode is set less than two times of a liquid crystal capacitance between the pixel electrode and the counter electrode which is obtained in a state that no voltage is applied thereto.

7. A flat-panel display device according to claim 5, wherein each storage capacitance line is disposed to extend into an area surrounding the corresponding pixel electrode on at least one side where the second adjacent scanning line is located.

8. A flat-panel display device according to claim 4, wherein each switching element is a thin film transistor which has a gate electrode formed of the corresponding scanning line, a drain electrode extended from the corresponding signal line, and a source electrode connected to the corresponding pixel electrode.

9. A flat-panel display device according to claim 8, wherein said drain electrode is disposed to extend into an area between the corresponding pixel electrode and the second adjacent scanning line.

10. A display control apparatus for a display panel which includes a plurality of display pixels arranged in a matrix, a plurality of scanning lines formed along rows of the display pixels, a plurality of signal lines formed along columns of the display pixels, and a plurality of switching elements formed in the vicinity of intersections between the scanning lines and the signal lines and each driven via a corresponding scanning line to apply a potential of the corresponding signal line to a corresponding display pixel, said apparatus comprising:

a scanning line driver for periodically selecting at least two adjacent scanning lines from the plurality of scanning lines to drive the adjacent scanning lines together; and a scanning controller for controlling said scanning line driver to turn on the switching elements connected to a first one of the adjacent scanning lines which is located on one side of a row of the display pixels capacitively coupled thereto and driven for the row of display pixels, and the switching elements connected to a second one of the adjacent scanning lines which is located on another side of the row of display pixels capacitively coupled thereto and not driven for the row of display pixels, at a substantially identical timing, and to turn off the switching elements connected to the second adjacent scanning line at an earlier timing than that for the switching elements connected to the first adjacent scanning line by a predetermined period.

11. A display control method for a display panel which includes a plurality of display pixels arranged in a matrix, a plurality of scanning lines formed along rows of the display pixels, a plurality of signal lines formed along columns of the display pixels, and a plurality of switching elements formed in the vicinity of intersections between the scanning lines and the signal lines and each driven via a corresponding scanning line to apply a potential of the corresponding signal line to a corresponding display pixel, said apparatus comprising: the steps of periodically selecting at least two adjacent scanning lines from the plurality of scanning lines to drive the adjacent scanning lines together; and performing a control of turning on the switching elements connected to a first one of the adjacent scanning lines which is located on one side of a row of the display pixels capacitively coupled thereto and driven for the row of display pixels, and the switching elements connected to a second one of the adjacent scanning lines which is located on another side of the row of display pixels capacitively coupled thereto and not driven for the row of display pixels, at a substantially identical timing, and of turning off the switching elements connected to the second adjacent scanning line at an earlier timing than that for the switching elements connected to the first adjacent scanning line by a predetermined period.

* * * * *